US007464557B2

(12) United States Patent
Vandor et al.

(10) Patent No.: US 7,464,557 B2
(45) Date of Patent: Dec. 16, 2008

(54) SYSTEM AND METHOD FOR COLD RECOVERY

(76) Inventors: David Vandor, 26 Leroy Ave., Tarrytown, NY (US) 10591-4608; Ralph Greenberg, 795 White Oak Dr., Santa Rosa, CA (US) 95409

( * ) Notice: Subject to any disclaimer, the term of this patent is extended or adjusted under 35 U.S.C. 154(b) by 349 days.

(21) Appl. No.: 11/354,503

(22) Filed: Feb. 15, 2006

(65) Prior Publication Data

US 2007/0186563 A1 Aug. 16, 2007

(51) Int. Cl.
*F17C 9/02* (2006.01)
*F25J 1/00* (2006.01)

(52) U.S. Cl. ..... 62/50.2; 62/614

(58) Field of Classification Search ..... 62/50.2, 62/614, 50.7

See application file for complete search history.

(56) References Cited

U.S. PATENT DOCUMENTS 2,975,604 A * 3/1961 McMahon ..... 62/614
3,018,632 A * 1/1962 Keith ..... 62/614
3,034,309 A * 5/1962 Muck ..... 62/50.2
3,400,547 A * 9/1968 Williams et al. ..... 62/50.1
3,962,881 A * 6/1976 Muska ..... 62/606
3,992,891 A 11/1976 Pocrnja
4,329,842 A 5/1982 Hoskinson
4,399,659 A * 8/1983 Strigl ..... 62/50.2
4,731,102 A 3/1988 Yoshino
4,819,454 A 4/1989 Brigham
6,012,292 A * 1/2000 Gulati et al. ..... 62/50.7
6,131,407 A * 10/2000 Wissolik ..... 62/606
6,367,258 B1 4/2002 Wen
6,920,759 B2 7/2005 Wakana

* cited by examiner

*Primary Examiner*—William C Doerrler
(74) *Attorney, Agent, or Firm*—Michael A. Blake

(57) ABSTRACT

A method of cold recovery in a cold compressed natural gas cycle, the method comprising: compressing air; drying air; heat exchanging air with cold compressed natural gas from a storage vessel, in a first heat exchanger, thereby forming cooled air; heat exchanging the cooled air with liquid methane, in a second heat exchanger, such that the cooled air becomes liquid air and the liquid methane becomes methane; heat exchanging the liquid air with natural gas from a pipeline, in a third heat exchanger, such that the natural gas cools to a cold compressed natural gas and the liquid air becomes air in a gaseous state; discharging the air in a gaseous state. A system of cold recovery comprising: an air dryer; an air compressor in fluid communication with the air dryer; a first heat exchanger in fluid communication with the air compressor; a second heat exchanger in fluid communication with the first heat exchanger; a third heat exchanger in fluid communication with the second heat exchanger; a methane expander valve in fluid communication with the second heat exchanger; a fourth heat exchanger in fluid communication with the methane expansion valve; a methane compressor in fluid communication with the second heat exchanger and with the fourth heat exchanger; a natural gas scrubber in fluid communication with a third heat exchanger; a natural gas pipeline in fluid communication with the first heat exchanger; the fourth heat exchanger, and the natural gas scrubber; and a storage vessel in fluid communication with the first heat exchanger, the third heat exchanger, and the fourth heat exchanger.

7 Claims, 7 Drawing Sheets

SYSTEM AND METHOD FOR COLD RECOVERY

TECHNICAL FIELD

The present invention relates generally to cold recovery for natural gas storage and transportation, and, in particular, to a method and system for cold recovery in a cold compressed natural gas transportation and/or storage systems

BACKGROUND

As part of the inflow and outflow cycles associated with the storage of Cold Compressed Natural Gas (CCNG) and other methane and non-methane cryogenic fluids in large storage vessels, (such as CCNG storage in solution-mined salt caverns), a great deal of refrigeration energy is stored in the cryogenic fluid which if not recovered during an outflow cycle of the CCNG, to a pipeline for example, would require significant amounts of refrigeration energy input during a subsequent inflow cycle of CCNG, from a pipeline for example.

The storage of CCNG in solution mined salt caverns is not a technology that has yet been deployed anywhere in the world. The cold recovery invention will allow the operation of CCNG storage caverns and CCNG pipelines to rely on smaller refrigeration units which will use less power, thus reducing the capital, financing, and operating costs of the entire CCNG storage and/or transport system and allowing the CCNG pipeline to be a cost-effective way of upgrading existing warm CNG pipelines, thus achieving significant increases in natural gas throughput. Thus, there is a need for recovery of refrigeration at CCNG storage sites.

SUMMARY OF THE INVENTION

The invention relates to a method of cold recovery in a cold compressed natural gas cycle, the method comprising: compressing air; drying air; heat exchanging air with cold compressed natural gas from a storage vessel, in a first heat exchanger, thereby forming cooled air; heat exchanging the cooled air with liquid methane, in a second heat exchanger, such that the cooled air becomes liquid air and the liquid methane becomes methane; heat exchanging the liquid air with natural gas from a pipeline, in a third heat exchanger, such that the natural gas cools to a cold compressed natural gas and the liquid air becomes air in a gaseous state; discharging the air in a gaseous state.

The invention also relates to a system of cold recovery comprising: an air dryer; an air compressor in fluid communication with the air dryer; a first heat exchanger in fluid communication with the air compressor; a second heat exchanger in fluid communication with the first heat exchanger; a third heat exchanger in fluid communication with the second heat exchanger; a methane expander valve in fluid communication with the second heat exchanger; a fourth heat exchanger in fluid communication with the methane expansion valve; a methane compressor in fluid communication with the second heat exchanger and with the fourth heat exchanger; a natural gas scrubber in fluid communication with a third heat exchanger; a natural gas pipeline in fluid communication with the first heat exchanger; the fourth heat exchanger, and the natural gas scrubber; and a storage vessel in fluid communication with the first heat exchanger, the third heat exchanger, and the fourth heat exchanger.

The invention also relates to a system of cold recovery comprising: a first subsystem; a CCNG pipeline in fluid communication with the first subsystem; a second subsystem in fluid communication with the CCNG pipeline; and wherein the CCNG pipeline is configured to deliver liquid air from the first subsystem to the second subsystem, and the CCNG pipeline is further configured to deliver CCNG from the second subsystem to the first subsystem.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
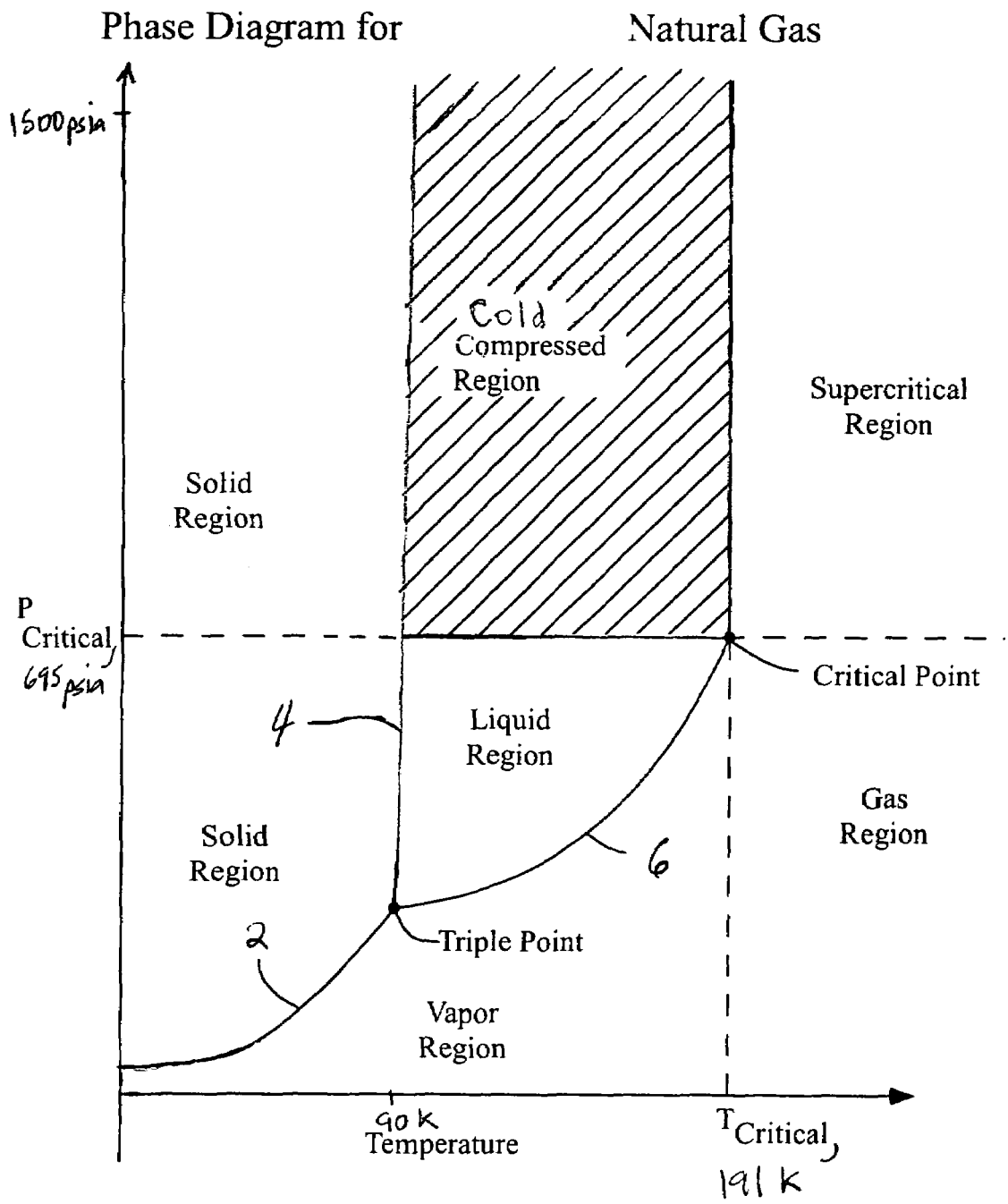
FIG. 1 is a phase diagram for natural gas.

FIG. 1 is a phase diagram of for natural gas. Although this patent application discusses the invention with respect to natural gas and various compositions of natural gas, such as methane, one of ordinary skill in the art will understand that the disclosed application applies also to methane, a main component of natural gas. Methane and natural gas are similar but not identical. Typical natural gas contains about 94% methane, 3% heavier hydrocarbons and 3% CO2 plus nitrogen as well as small quantities of water and sulfur compounds. CO2, water and sulfur are usually removed prior to chilling the natural gas to prevent freeze-out. The phase diagram, FIG. 1, can apply to natural gas because it is qualitative in nature. Specific values for critical pressure and critical temperatures discussed in this patent application are for pure methane, however, it will be obvious to those of ordinary skill that slightly different values for critical pressure and critical temperature will be used for natural gas, the exact values will be dependant on the composition of the particular natural gas. Also, when methane or natural gas are used in association with a specific system component, such a "methane expander", one of ordinary skill in the art will recognize that the terms "methane" and "natural gas" may be interchangeable. At the triple point, the natural gas can exist as a solid, vapor and liquid. A solid-vapor coexistence curve 2 extends downwards and leftwards from the triple point. A solid-liquid coexistence curve 4 extends generally upwards from the triple point. A liquid-vapor coexistence curve 6 extends upwards and rightwards from the triple point up to the critical point. It is generally accepted that above the critical temperature ("$T_{CRITICAL}$") and above the critical pressure ("$P_{CRITICAL}$") for a composition, it exists in a supercritical state. The region above the critical temperature and above the critical pressure shall be referred to the as the supercritical region, and fluids within that region shall be referred to as supercritical fluids. The region to the left of the supercritical region, that is, the region above the critical pressure, and below the critical temperature, and to the right of the solid-liquid coexistence curve shall be referred to as the cold compressed region in this disclosure, and fluids within that region shall be referred to as cold compressed fluids, and natural gas in the cold compressed region shall be referred to as CCNG. The cold compressed region is indicated by the hatch marks in FIG. 1. Fluids in the supercritical region have unique properties, including existing as a single phase fluid. Fluids in the cold compressed region have some of the same characteristics of supercritical fluids, including existing as a single phase fluid. Additionally, fluids in the cold compressed region have densities approaching that of LNG. It should be noted that fluids in the cold compressed region are not technically in a liquid phase, but are technically in a gas phase.

The invention is the recovery (during outflow to a pipeline from cavern storage) and the storage of the "coldness" (refrigeration) inherent in the stored CCNG, for use as a significant portion of the refrigeration required to convert incoming natural gas from its ambient temperature conditions to CCNG. The terms "outflow" and "outgoing" mean the delivery of natural gas from a storage to a transportation means such as a natural gas pipeline. Similarly, the terms "inflow" and "inflowing" mean the delivery of natural gas from a transportation means to a storage facility. The use of CCNG was described in patent application Ser. No. 11/131,122 filed on May 16, 2005, entitled "Cold Compressed Natural Gas Storage And Transportation" and incorporated herein in its entirety. The invention is also the recovery of refrigeration from CCNG during its warming at the end of a CCNG pipeline where the CCNG is converted to CNG on its way into a standard, non-cryogenic pipeline. Such a CCNG pipeline may be deployed in various contexts, including the following: as a connection between a CCNG cavern and a standard pipeline or end-use point for the natural gas (such as a power plant); as a connection from an LNG import terminal or LNG production facility to a standard pipeline or end use point; or as a stand-alone CCNG pipeline that may connect two standard pipelines, including as a reconfiguration of an existing warm CNG line to a CCNG line in order to eliminate existing throughput "bottlenecks" in the natural gas distribution system. The cold recovery is achieved by heat exchange between a stream of moderately pressurized (dry) air and first, the outgoing CCNG, followed by a stream of evaporating methane, resulting in low-pressure significantly chilled air. The CCNG, at about −150° F., serves to produce a temperature that is low enough to significantly chill the dry, moderate pressure air, by utilizing a process known as "heat pumping". A separate, closed loop, methane compressor compresses methane to approximately 350 psig, which can be liquefied by heat exchange with the about −150° F. CCNG. The liquid methane is letdown in pressure and evaporates at a low enough temperature to liquefy the dry, moderately pressurized air. The vaporized methane is warmed to ambient and recompressed. This process makes it possible to utilize the about −150° F. CCNG to liquefy air with a modest input of power. The methane will liquefy the moderately compressed air, which when flashed to atmospheric pressure forms a liquid at about −290° F. and a small quantity of cold vaporized air which is vented to the atmosphere after refrigeration recovery from that vapor. The resultant liquid air can be stored in an aboveground, low-pressure, insulated, cryogenic tank that is commonly available for the storage of such low-pressure cryogenic fluids. Thus, ordinary dried air, which is free and abundant and requires only a moderate amount of compression, is the "working fluid" that will serve to receive and hold the coldness that must be given up by the CCNG before it can be inserted into a standard pipeline. Standard pipelines are not designed to accept natural gas at cryogenic temperatures.

Sometime after the outflow of CCNG, when CCNG is sent to, a standard pipeline, the stored refrigeration energy contained in the liquid air is used as a significant portion of the refrigeration required to chill the incoming natural gas at ambient temperatures that will replace the sent-out CCNG, to form new CCNG at about −150° F. Thus, the relatively modest energy input required to compress the air prior to it being liquefied by the CCNG outflow, is more than offset by the value of the refrigeration energy that was saved in the liquid air and re-used to make the next batch of CCNG, even accounting for losses during the process. The same process offers the same benefits at a CCNG pipeline, by capturing and re-using the coldness of the CCNG as it leaves the CCNG pipeline on its way to a standard (warm) CNG pipeline, where the captured coldness is sent back to the beginning of the CCNG pipeline for use in chilling the incoming warm CNG gas flow.

Once the liquid air gives up its stored refrigeration energy to the incoming natural gas flow, it can be discarded, because it is not a hazardous emission. Thus, unlike nearly all other refrigerants, air as the working fluid only needs to be contained during its cold storage state (as a liquid), without the need for containment during its warm, vaporized state. In the case of a "stand alone" CCNG pipeline, such as might be deployed at an existing "bottleneck" in the natural gas pipeline system, the need for liquid air containment can be negligible because the liquid air is transferred constantly from the end of the CCNG pipeline to its beginning, and used immediately to chill incoming warm CNG.

Figure 2:
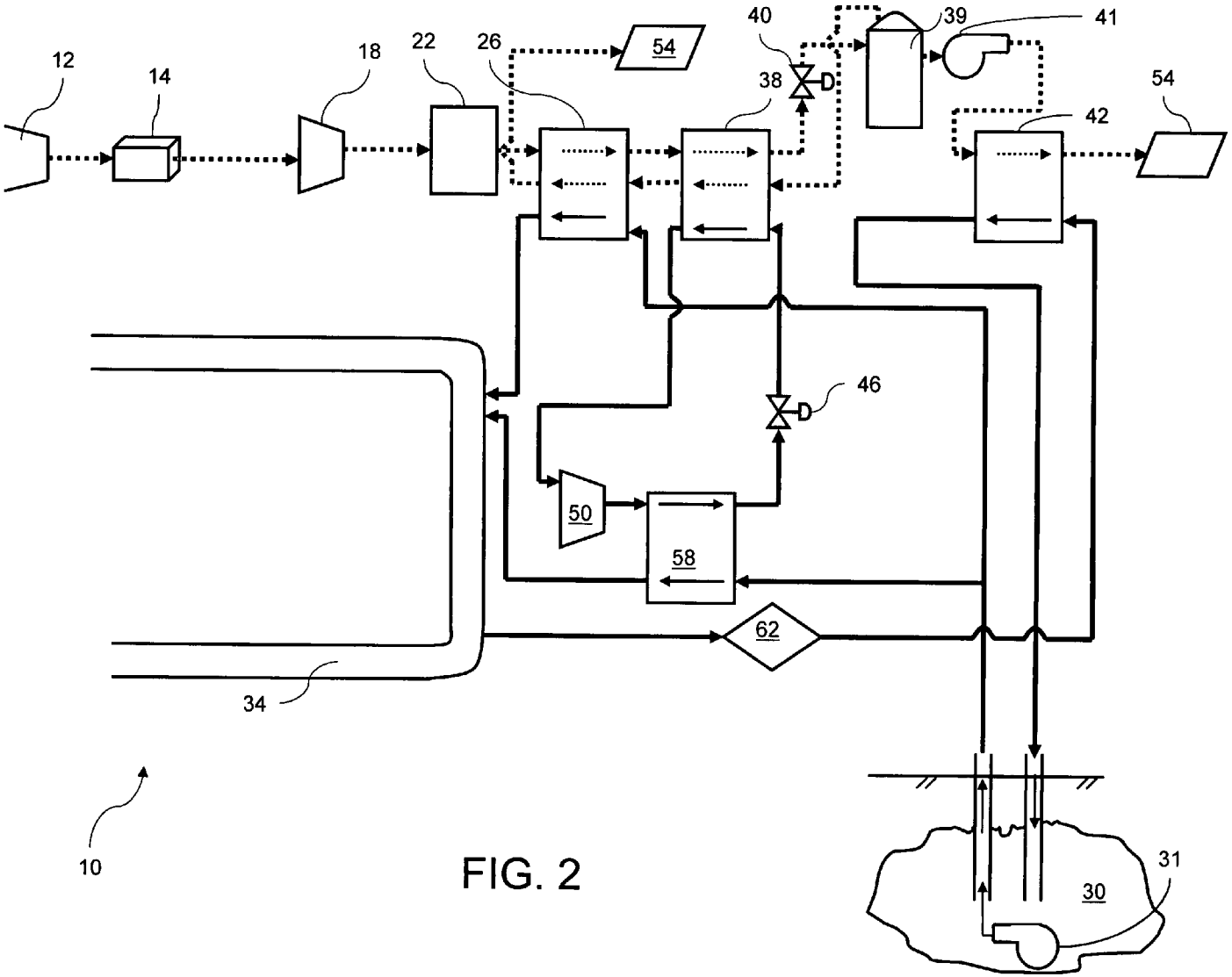
FIG. 2 is a schematic view of one embodiment of the disclosed cold recovery system.

Referring to FIG. 2, a schematic of a disclosed system 10 for cold recovery is shown. The system comprises an air source 12 in fluid communication with an air filter 14. The air source 12 may be, but not limited to: ambient air, air in containers, piped in air. The air filter 14 is in fluid communication with an air compressor 18. The air compressor 18 is fluid communication with an air dryer 22. The air dryer 22 is in fluid communication with a first heat exchanger 26. The first heat exchanger is in fluid communication with a second heat exchanger 38, a storage vessel, such as but not limited to a subterranean cavern storage facility 30, and a natural gas pipeline 34. The second heat exchanger 38 is in fluid communication with a liquid air storage tank 39, an air expansion valve (also known as a pressure control valve) 40, a methane expansion valve (also known as a pressure control valve) 46, and a methane compressor 50. The third heat exchanger 42 is in fluid communication with a liquid air pump 41, an air discharge 54, a natural gas scrubber 62, and the cavern storage 30. The natural gas scrubber 62 is in fluid communication with the natural gas pipeline 34. A fourth heat exchanger 58 is fluid communication with the methane expander valve 46, methane compressor 50, the cavern storage 30, and the natural gas pipeline 34. In FIG. 2, the path taken by air, whether in a gas or liquid state, is shown by the dotted arrows, the path taken by methane (natural gas) whether in a gas, liquid state or CCNG state, is shown by the solid arrows. A cold compressed natural gas pump 31 may be located in the subterranean cavern storage facility 30. In another embodiment, the cold compressed natural gas pump 31 may be located between subterranean cavern storage facility 30 and the first heat exchanger 26. The cold compressed natural gas pump 31 may be a submerged cryogenic pump. The pumping of a "near liquid" natural gas (such as CCNG) is known in the art.

Figure 3:
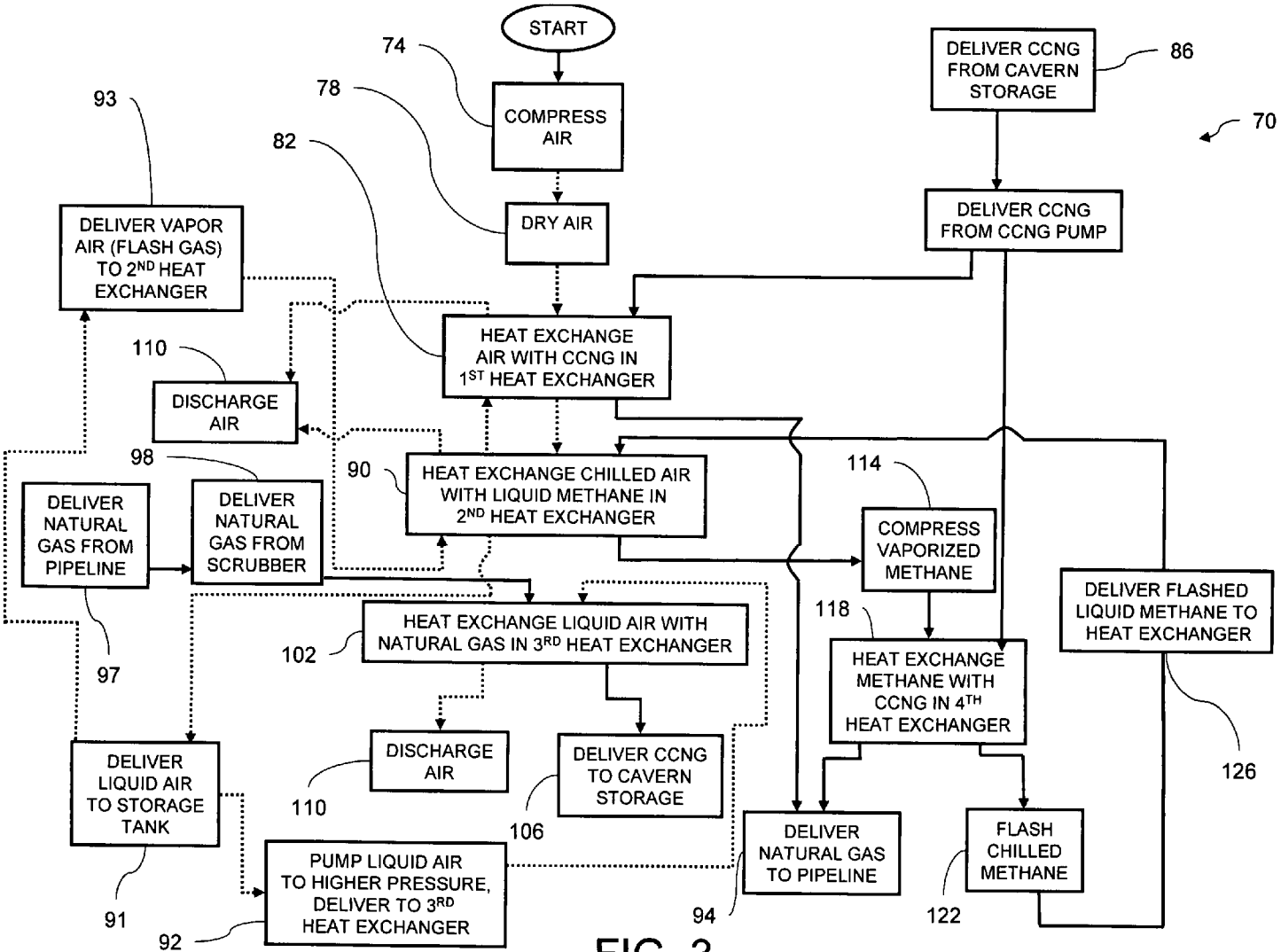
FIG. 3 is a flowchart illustrating one embodiment of the disclosed method of cold recovery.

Referring to FIG. 3, a method for refrigeration 70 is disclosed. At act 74, air is compressed by a compressor 22. At act 78, air is dried in an air dryer 22. At act 82 the air is heat exchanged with CCNG in a first heat exchanger 26. CCNG is delivered from the cavern storage 30 to the CCNG pump 31 at act 86. At act 87, CCNG is delivered from the CCNG pump 31 to the first heat exchanger 26 and to the fourth heat exchanger 58. At act 90, the chilled air is heat exchanged with liquid methane at a second heat exchanger 38 such that the chilled air achieves a liquid state. At act 91 liquid air is delivered to a cryogenic storage tank 39. At act 94, the CCNG that was warmed at act 82, leaves its cold compressed state, becomes a standard gaseous state natural gas and is delivered to a natural gas pipeline 34. Prior to giving up its coldness, the CCNG can be pumped or compressed to any desired pressure, thus allowing it to enter the standard pipeline at the required pressure for that pipeline. At act 97, natural gas is delivered from a pipeline to the scrubber 62. At act 98, natural gas is delivered from the scrubber 62 to third heat exchanger 42. At act 92 liquid air is pumped to a higher pressure by the liquid air pump 41 and then delivered to the 3$^{rd}$ heat exchanger. At act 102, liquid air is heat exchanged with the natural gas in the third heat exchanger 42. The cooling of the natural gas at act 102 changes the state of the natural gas to a cold compressed state, and is therefore now referred to as CCNG. At act 106, the CCNG is delivered to a cavern storage 30 for storage. At act 110, liquid air warmed during act 102 has become gaseous again, and may now be discharged into the atmosphere. At act 114 methane, which was in a liquid state prior to act 90, and is now in a gaseous state, is compressed by methane compressor 50. At act 118, the compressed gaseous methane is heat exchanged with CCNG at the fourth heat exchanger 58. At act 86, CCNG is delivered from cavern storage 30, to the fourth heat exchanger 58. At act 122, the methane, now in a liquid state, is depressurized or flashed in an expansion valve 46. At act 94, the warmed natural gas, formerly in a cold compressed state, now in a standard gaseous state, is delivered to the natural gas pipeline 34. At act 126, the flashed liquid methane is delivered to the second heat exchanger 38. At act 93, the flashed liquid air, now in a vapor state, is delivered to the second heat exchanger 38.

Figure 4:
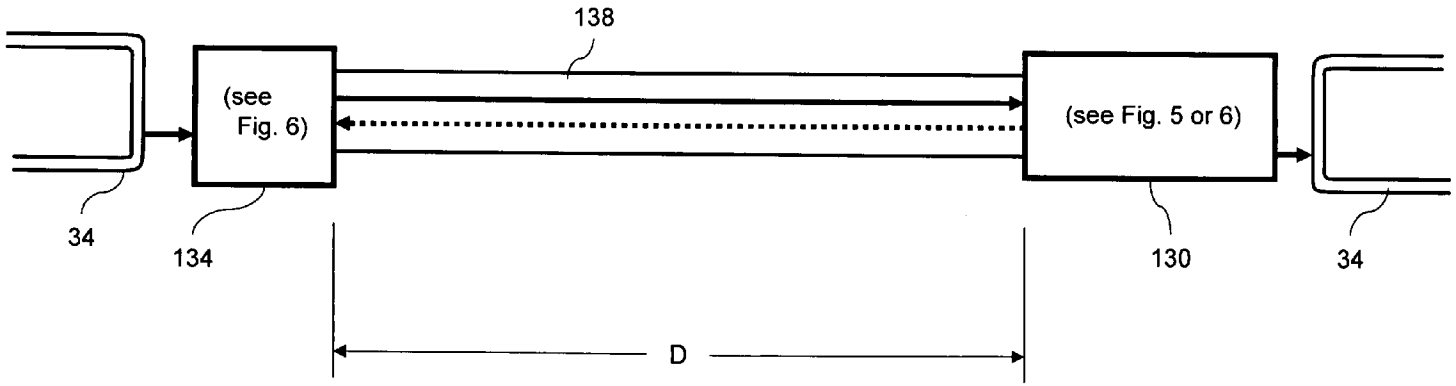
FIG. 4 is a schematic showing the relation of subsystem 130 and subsystem 134.

The cold recovery system described with respect to FIG. 2 above may be split into at least two subsystems 130, 134 a distance "D" apart as shown in the schematic pictured in FIG. 4. The distance D may be about 20 to about 50 miles apart, or the distance may be less or greater than that range depending on pipeline size, flow rate and pressure drop limitations. Subsystems 130 and 134 are in communication with each other via a CCNG pipeline 138. The CCNG pipeline transports CCNG from subsystem 134 to subsystem 130, additionally the CCNG pipeline transports liquid air from subsystem 130 to subsystem 134. The CCNG pipeline is configured such that the liquid air keeps the CCNG from heating up excessively during its travel in the CCNG pipeline. Both subsystems 130, 134 are in fluid communication with a natural gas pipeline 34. If warranted by operational needs, the directional arrows for the CCCNG and for the liquid air can be reversed, allowing for the CCNG pipeline to move product in the reverse direction. Such flexibility may be achieved by the placement of redundant components at both ends of the pipeline. For example, a CCNG pipeline that might connect a CCNG cavern to a standard pipeline at say, 25-miles away, may need the CCNG pipeline to move warm CNG from the standard pipeline during an inflow period and may need to move CCNG to the warm CNG pipeline during an outflow period. In order to allow for that two-way flow, the gas clean up system needs to be at the connection between the CCNG line and the warm CNG line. However, the liquid air production and storage system can be located at the CCNG cavern site, because the liquid air transport tube (154 in FIG. 7) can "send" refrigeration from the liquid air storage facility at the cavern to the inflow at the distant warm CNG connection point. If the CCNG cavern has other inflow sources, then the gas clean up equipment may need to be redundant, with at least one at the end of the CCNG pipeline, where it connects with the warm CNG pipeline, and at the other inflow locations that bring product to the CCNG cavern. Supplemental refrigeration may also be needed at the CCNG pipeline's end to augment the refrigeration provided by the arriving liquid air. Similarly, at a stand-alone CCNG pipeline, such as shown in FIG. 4, the gas clean up equipment, the cold recovery equipment and the supplemental refrigeration to convert the compressed cold air to liquid air will need to be redundant at both ends, but the liquid air storage system can be located in a single location at either end.

Figure 5:
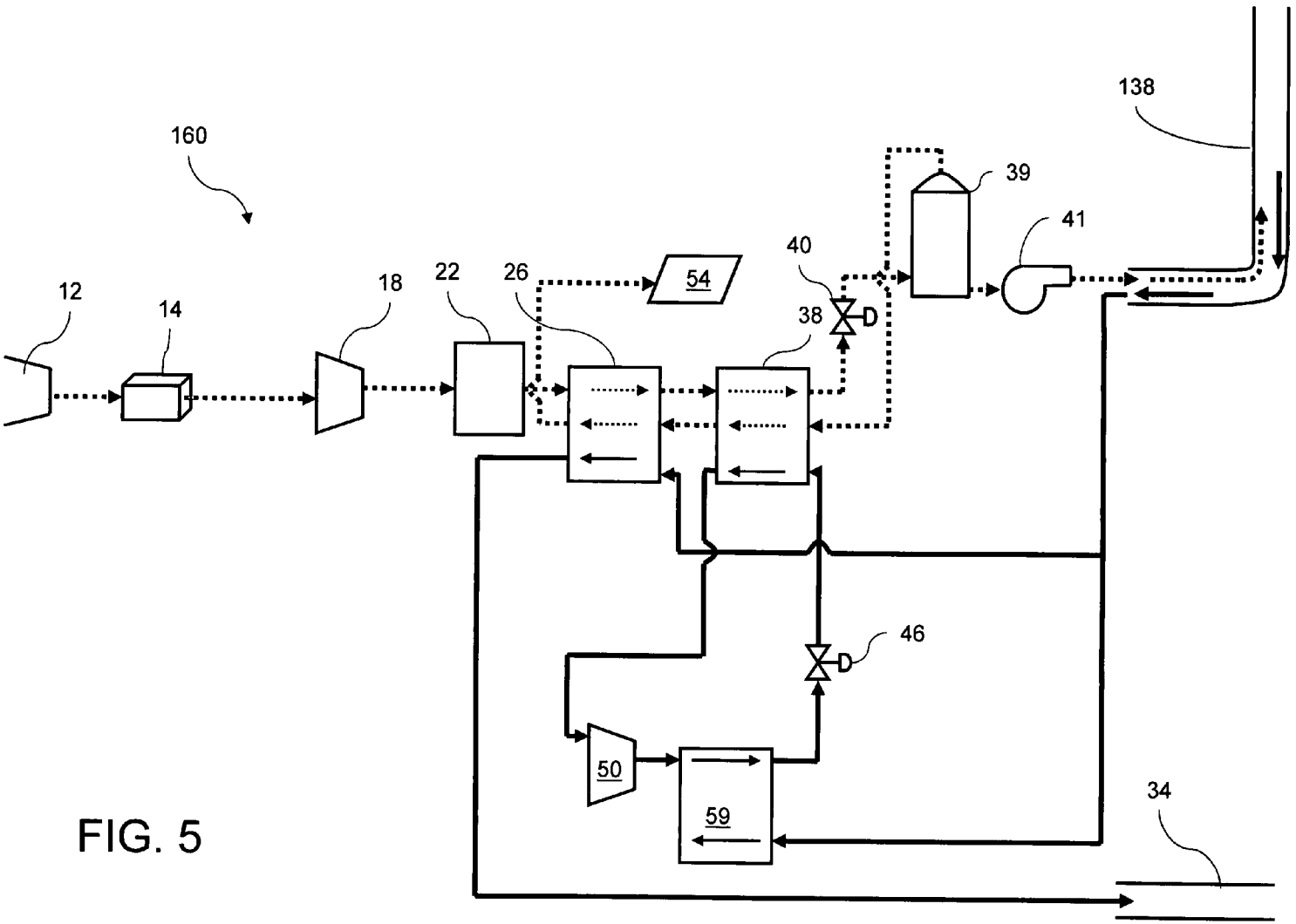
FIG. 5 is a schematic of subsystem 130.

Referring now to schematic shown in FIG. 5, the subsystem 130 comprises an air source 12 in fluid communication with an air filter 14. The air filter 14 is in fluid communication with an air compressor 18. The air compressor 18 is fluid communication with an air dryer 22. The air dryer 22 is in fluid communication with a first heat exchanger 26. The first heat exchanger is in fluid communication with a second heat exchanger 38, a CCNG pipeline 138, and a natural gas pipeline 34. The second heat exchanger 38 is in fluid communication with a liquid air storage tank 39 an air expansion valve 40, a methane expansion valve 46, and a methane compressor 50. A liquid methane heat exchanger 59 is in fluid communication with the methane expander valve 46, methane compressor 50, the CCNG pipeline 138, and the natural gas pipeline 34. In another embodiment, the storage tank 39 may be omitted if the system 10 is configured to such that the CCNG pipeline is always "on", moving CCNG to a CNG line, there would be very little need for a storage tank because the liquid air return line would move the cold liquid air back to the beginning, where it would be used to chill the incoming CCNG. Alternatively, if the CCNG pipeline were connected to a CCNG cavern, then the liquid air storage tank would be located back at the cavern, where the liquid air needs to be stored for future chilling.

Figure 6:
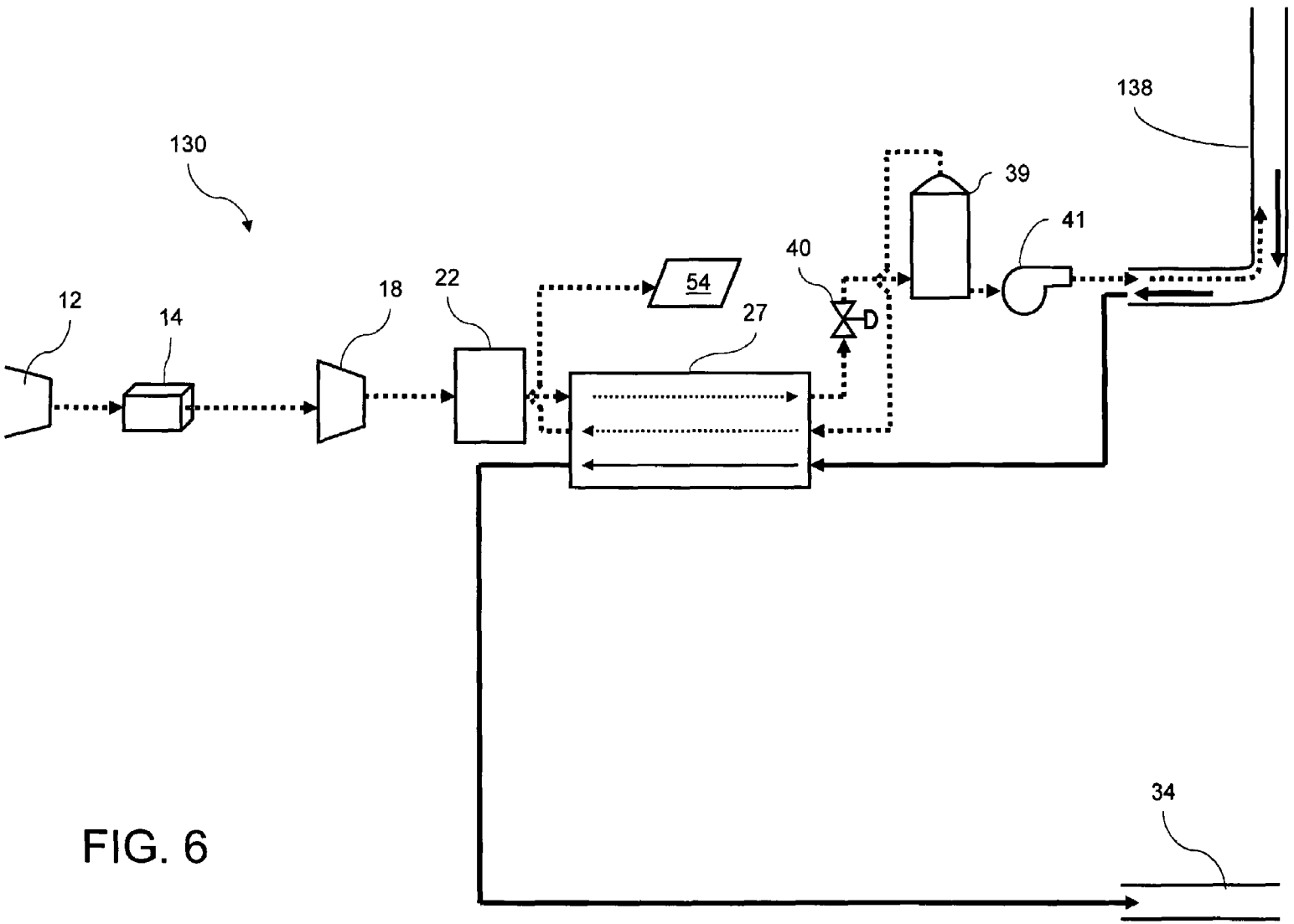
FIG. 6 is a schematic of another embodiment of subsystem 130.

FIG. 6 is a schematic showing another embodiment of the subsystem 130. the subsystem 130 comprises an air source 12 in fluid communication with an air filter 14. The air filter 14 is in fluid communication with an air compressor 18. The air compressor 18 is fluid communication with an air dryer 22. The air dryer 22 is in fluid communication with a single heat exchanger 27. The single heat exchanger 27 is in fluid communication with a CCNG pipeline 138, and a natural gas pipeline 34, a liquid air storage tank 39, an air expansion valve 40. In still another embodiment, the storage tank 39 may be omitted if the system 10 is configured to such that the CCNG pipeline is always "on", moving CCNG to a CNG line, there would be very little need for a storage tank because the liquid air return line would move the cold liquid air back to the beginning, where it would be used to chill the incoming CCNG. Also, if the CCNG pipeline were connected to a CCNG cavern, then the liquid air storage tank would be located back at the cavern, where the liquid air needs to be stored for future chilling.

Figure 7:
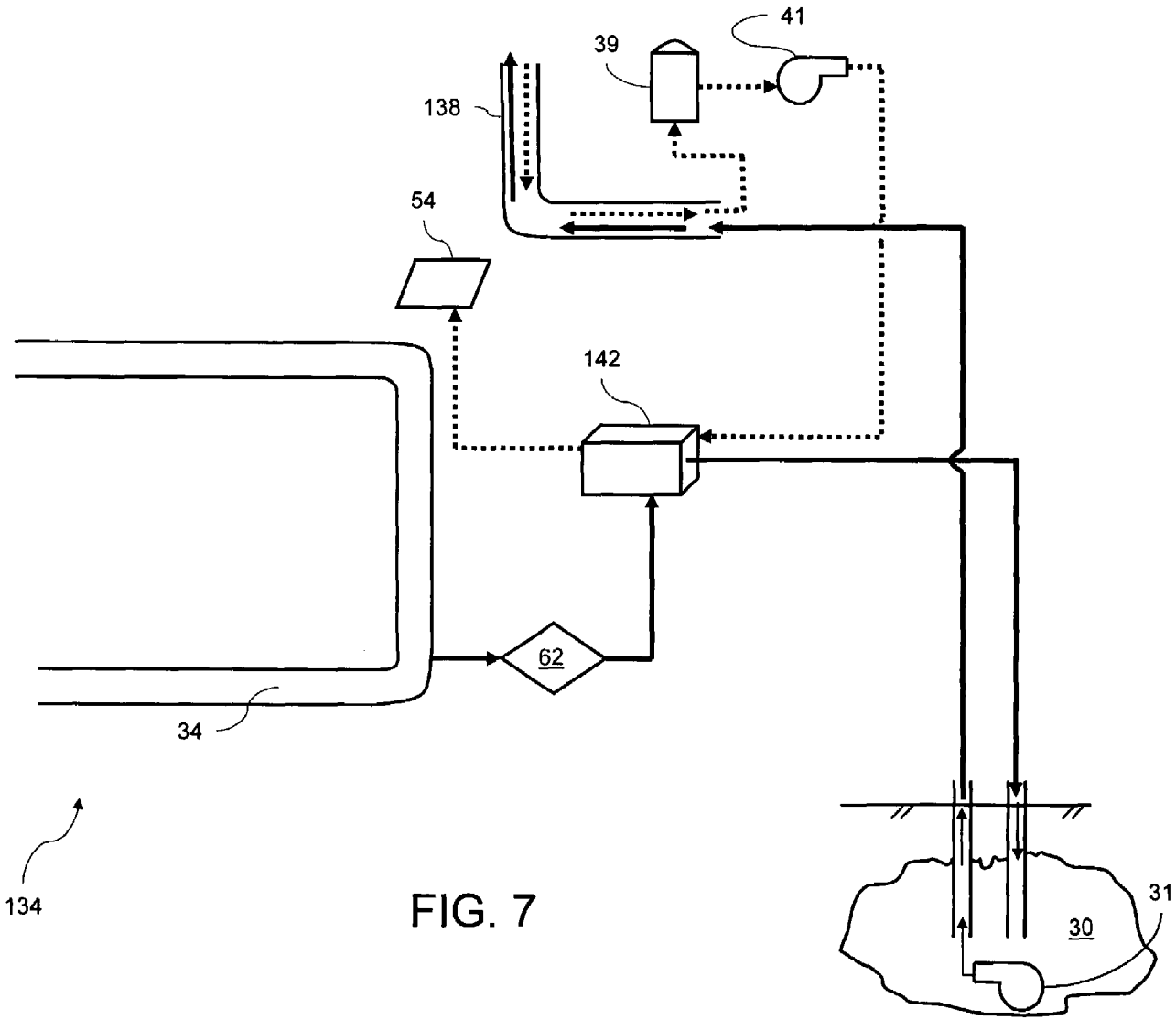
FIG. 7 is a schematic of subsystem 134.

Referring now to FIG. 7, subsystem 134 comprises the CCNG pipeline 138 which is in fluid communication with a liquid air tank 39. The liquid air tank 39 is in fluid communication with a liquid air pump 41. The CCNG pipeline is also in communication with a cavern storage 30. A chilling cycle system 142 is in fluid communication with the liquid air pump 41, the cavern storage 30, an air discharge 54, and a natural gas scrubber 62. The chilling cycle system 142 employs any of a number of known chilling cycles to change the state of natural gas from the natural gas pipeline 34 to a CCNG using as part of its refrigeration source, liquid air delivered via the liquid air pump 41, and using as the natural gas feed source, pipeline quality natural gas from the natural gas pipeline 34. Once natural gas from the pipeline 34 achieves a Cold Compressed state by the chilling cycle system 142, the CCNG may be delivered to the subterranean cavern storage facility 30 (as shown in FIG. 7), or it may be directly delivered to the CCNG pipeline 138 and ultimately delivered to the subsystem 130 described in FIG. 4. In FIGS. 4, 5 6, and 7, the path taken by air, whether in a gas or liquid state, is shown by the dotted arrows, the path taken by methane (natural gas) whether in a gas, liquid, or CCNG state, is shown by the solid arrows. A cold compressed natural gas pump 31 may be located in the subterranean cavern storage facility 30.

Figure 8:
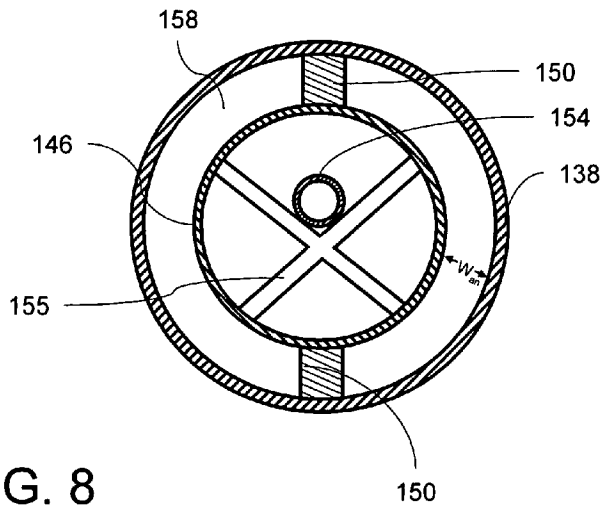
FIG. 8 is a cross-sectional diagram of a CCNG pipeline.

Referring now to FIG. 8, a cross-sectional view of the CCNG pipeline 138 is shown. The inner diameter of the pipeline 138 maybe about 24 inches, or any other suitable size. Located concentrically within the pipeline 138 is a CCNG pipe 146. Spacers 150 may be located in the annulus 158 between the pipeline 138 and CCNG pipe 146 in order to hold the CCNG pipe 146 in a concentric configuration with respect to the pipeline 138. The spacers (which may be non metallic with very low heat transfer characteristics) allow a vacuum to be maintained between 138 and 146. The spacers may be "perforated" so that the vacuum is not limited to "compartments" between the spacers. Located in an eccentric position inside the CCNG pipe is a liquid air tube 154. The liquid air tube 154 may be located in generally in the center of the CCNG pipe 146 supported by periodically spaced X struts 155 or A frames. The X struts are not continuous, i.e. they do not run the length of the CCNG pipe 146, thereby allowing the CCNG to flow smoothly all around the liquid air tube. One of ordinary skill will recognize that the X shape of the X struts 155 may be any shape suitable to support the liquid air tube 154. In another embodiment, the liquid air tube may simply lie on the floor of the CCNG pipe 146. The liquid air tube 154 may be located anywhere (eccentric or concentric) within the CCNG pipe 146, including at the bottom (the floor) or welded to the top (the ceiling of the CCNG pipe 146). If the liquid air tube 154 is located more or less in the center (as shown in FIG. 8) it will be in an optimum position relative to giving up some of the coldness of the liquid air to the CCNG. However, even if the liquid air tube 154 is located on the floor or ceiling of the CCNG pipeline 146, it will be almost as beneficial to the CCNG. There may be some significant benefits to having the tube 154 adjacent to the CCNG pipeline wall. For example, at some CCNG pipeline diameters, federal regulations may require that a "pig" be able to travel the length of the line to look for corrosion, "dings", and other signs of trouble. Thus the specific "schematic" design shown in FIG. 8 may work for a small diameter, short run CCNG line, but may not be appropriate for a larger diameter, longer run pipeline where a traveling "pig" is needed. Thus it should be obvious to one of ordinary skill in the art that FIG. 8 is only one possible illustration of how the liquid air tube 154 and CCNG pipeline 146 might be integrated within an outer casing and a vacuum in between. A vacuum is pulled within the annulus 158. Not shown in FIGS. 4 and 7 are periodically located vacuum pumps located at the ends or along the length of the CCNG pipeline. The "seal" around the outer pipeline 138 need not be very sophisticated because the vacuum that is needed to virtually eliminate any heat gain need to the CCNG inner pipe will not be a "perfect" vacuum. This vacuum provides for an insulation barrier to prevent excessive heat transfer from within the CCNG pipe 146 to the exterior of the CCNG pipe 146. Both the CCNG pipe 146 and liquid air tube 154 may be made from stainless steel, nickel-steel alloy, or any other suitable material. The liquid air in the liquid air tube 154 may be at about −300° F. and about 100 psi. The CCNG in the CCNG pipe may be maintained at about −150° and colder and about 700 psi or greater. Additionally, CCNG pumps and liquid air pumps may be located along the pipeline 138 in order to maintain the CCNG and liquid air at the proper pressures. An outer coating and other standard pipeline construction techniques, such as to achieve cathodic protection, may also be employed. Other standard details, not shown, are connections to other CCNG pipelines and connections to intermediate warm CNG pipelines with cold recovery nodes at such intermediate connections. It should be noted that the pipeline 138 may be an existing standard carbon steel natural gas line that is "converted" to CCNG transport by lining it with a nickel steel CCNG line. Thus natural gas pipelines may be retrofitted to accommodate the disclosed invention. This retrofit ability is included in the disclosed invention. The width "$W_{an}$" of the annulus 158 may vary from about 0.5" for the smallest diameter CCNG pipeline to up to about 2" for large CCNG pipelines. The wall thickness for the nickel steel liner will likely be about 0.75" to about 1.0" depending on the diameter of the pipe and its operating pressure. While CCNG pipelines will have a less efficient relationship between their inside and outside diameters, the very high-density of the CCNG transported through the pipeline will more than offset that penalty and will allow several times the throughput of a standard pipeline of the same outside diameter.

Referring back to subsystem 130 and FIG. 5, once the CCNG arrives at subsystem 130 a distance D away from subsystem 134, the CCNG is ready to be warmed for insertion into the standard natural gas pipeline 34. During the warming of the CCNG, and using the disclosed cold recovery system, liquid air will be formed from the ambient air. That liquid air will be sent down the CCNG pipeline 138 to subsystem 134, while traveling down the CCNG pipeline 138 the liquid air will act to keep the CCNG cold. The liquid air tube 154 may be a about a 4 inches in diameter cryogenic pressure tube, contained within the CCNG pipe which may be about 12 inches in diameter. The entire tube-within-a-pipe assembly is in a pipeline 138 which may be made out of carbon steel, or concrete with a low tech vacuum between the CCNG pipe 154 and the pipeline 138. Because the liquid air tube 154 and the surrounding CCNG flow are not insulated from each other, the CCNG is kept very cold and the liquid air warms up slightly. The liquid air arrives at subsystem 134 where it is stored in a liquid air tank 39 or used immediately to chill more natural gas as it is converted to CCNG. If stored, the liquid air can be used later to chill natural gas into CCNG in the chilling cycle system 142. The benefit of this cold recovery at the subsystem 130 and transfer of the liquid air by liquid air tube 154 to the subsystem 134 is that a great deal of refrigeration is recovered, thus reducing the size and expense of the refrigeration system 142 needed to make CCNG and reducing power costs. The heat exchange (cold exchange) between the liquid air and oppositely flowing CCNG is a plus, allowing for a longer run between pumping stations and re-chilling stations. As the liquid air is finally used to chill the natural gas that will become CCNG, it vaporizes and may be disposed of into the ambient air.

The disclosed CCNG cold recovery system allows for a stand-alone CCNG pipeline to function cost effectively, even if it is not integrated with a CCNG cavern storage facility because the refrigeration loads (capital costs and operating costs) are reduced by way of the cold recovery process. The notion of about a 50-mile pipeline extension is often dependent on the cost of that pipeline. A CCNG line (with the cold recovery component), including all the refrigeration, pumping and vacuum maintenance equipment, will therefore be less costly. Also, the diagram in FIG. 8 may be used as an "upgrade" to an existing warm CNG pipeline, where 138 is the existing carbon steel line, and where 146, 150, 154 and the vacuum between 146 and 138 are "inserted" as a new "lining" into the existing pipeline. That conversion from CNG to CCNG flow will increase the throughput of product by 4 to 7 times, depending on the pipeline size, its prior pressure rating and the temperature of the newly transported CCNG. Such a conversion is especially valuable where existing warm CNG pipelines, operating at their rated pressure capacity, are creating "bottlenecks" in the natural gas pipeline delivery system. Also, such a conversion from warm CNG to CCNG transport will allow LNG arriving at shore-based LNG import terminals to be transported as CCNG to distant inland CCNG caverns, to end-users of natural gas (such as power plants), and to inland regional natural gas distribution lines.

The disclosed invention includes the capturing of the coldness of the −150° F. CCNG to pre-chill readily available gaseous air, at generally the same location and generally the same time as when the −150° F. CCNG needs to be warmed up to enter a natural gas pipeline. The pre-chilling of the air may then be followed by the addition of supplemental refrigeration to further chill the air so it becomes liquid, thus reducing its volume, allowing it to be stored in a low-pressure container, and allowing it to be transported as a liquid in a small diameter pipeline. A person of ordinary skill in the art will recognize that this patent application includes a different arrangement of cold recovery components. The disclosed invention allows about 80% of the refrigeration content inherent in the CCNG to be re-used to make the next batch of CCNG.

The invention further includes the use of liquid air as the working fluid (refrigerant) in short distance stand-alone CCNG pipelines (about 60 miles) because the dense, liquid form of the air allows it to used in a smaller internal pipe located in the CCNG pipeline.

The cold recovery invention disclosed herein may be applied in at least the following modes, and possibly more: a) at a CCNG cavern, with the cold recovery occurring at the surface, just before the CCNG is warmed for insertion into the standard pipeline; b) at the end of a CCNG pipeline that links a CCNG cavern to a standard pipeline some (relatively short) distance away, where the recovered cold is used either at that same location at a later time when warm NG is being sent to storage, or where the recovered cold is sent back to the CCNG cavern for use in chilling incoming NG from another pipeline; c) at a stand-alone, newly constructed CCNG pipeline, say, linking two standard pipelines or a standard pipeline and a large end user; d) at a stand-alone CCNG pipeline that is a "conversion" of a standard existing NG pipeline, such as at an existing bottleneck; e) at a CCNG pipeline that connects a shore-based LNG import terminal with an "inland" standard pipeline, where the recovered cold (L-air) is either sent back to the terminal or to some other location for the re-use of its refrigeration content in a variety of industrial scale cryogenic applications.

The invention of cold recovery applied to a CCNG pipeline may also work if that pipeline moves CCNG in both directions. That extra level of service requires that some of the equipment (for instance a natural gas clean up cycle and liquid air storage) be located redundantly at both ends of the CCNG pipeline.

It should be noted that in all discussions of one or more heat exchangers herein, in alternative embodiments, some or all of the heat exchangers may include placement within an insulated "cold box", thus controlling the heat gain to the respective exchanger and improving its efficiency. Such embodiments will be familiar to those of ordinary skill in the art of cryogenic gas processing and is within the scope of the disclosed invention.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims. This is especially true with regard to the total diameter of a CCNG pipeline, which may be quite small or quite large, and with regard to the total length of a CCNG pipeline, which can vary depending on such factors as its diameter, the efficiency of the vacuum jacketing, the temperature of the inserted CCNG, the desired pressure of the natural gas at the CCNG pipeline's end point, the frequency of pumping stations and supplemental refrigeration points along its path.

What is claimed is:

1. A method of cold recovery in a cold compressed natural gas cycle, the method comprising:

compressing air;

drying air;

heat exchanging air with cold compressed natural gas from a storage vessel, in a first heat exchanger, thereby forming cooled air;

heat exchanging the cooled air with liquid methane, in a second heat exchanger, such that the cooled air becomes liquid air and the liquid methane becomes methane;

heat exchanging the liquid air with natural gas from a pipeline, in a third heat exchanger, such that the natural gas cools to a cold compressed natural gas and the liquid air becomes air in a gaseous state;

discharging the air in a gaseous state; and delivering the cold compressed natural gas to a location selected from the group consisting of the storage vessel and a pipeline.

2. The method of claim 1, further comprising:

compressing the methane gas;

heat exchanging the compressed methane gas with cold compressed natural gas from the storage vessel, in a fourth heat exchanger, such that the methane becomes liquid methane and the cold compressed natural gas becomes natural gas in a typical gaseous state suitable for typical pipeline transportation;

delivering the natural gas to a pipeline;

expanding the liquid methane; and delivering the expanded liquid methane to the second heat exchanger.

3. A system of cold recovery comprising:

an air dryer;

an air compressor in fluid communication with the air dryer;

a first heat exchanger in fluid communication with the air compressor;

a second heat exchanger in fluid communication with the first heat exchanger;

a third heat exchanger in fluid communication with the second heat exchanger;

a methane expander valve in fluid communication with the second heat exchanger;

a fourth heat exchanger in fluid communication with the methane expansion valve;

a methane compressor in fluid communication with the second heat exchanger and with the fourth heat exchanger;

a natural gas scrubber in fluid communication with a third heat exchanger;

a natural gas pipeline in fluid communication with the first heat exchanger; the fourth heat exchanger, and the natural gas scrubber; and a storage vessel in fluid communication with the first heat exchanger, the third heat exchanger, and the fourth heat exchanger.

4. The system of claim 3, wherein the storage vessel is a subterranean storage facility.

5. The system of claim 3, further comprising:

a liquid air storage tank in fluid communication with the second heat exchanger; and a liquid air pump in fluid communication with the third heat exchanger and the liquid air storage tank.

6. A system of cold recovery comprising:

a first subsystem; the first subsystem comprising:

an air dryer;

an air compressor in fluid communication with the air dryer;

a first heat exchanger in fluid communication with the air compressor and with the CCNG pipeline;

a second heat exchanger in fluid communication with the first heat exchanger;

a methane expander valve in fluid communication with the second heat exchanger;

a liquid air expander valve in fluid communication with the second heat exchanger;

a liquid methane heat exchanger in fluid communication with the methane expansion valve;

a methane compressor in fluid communication with the liquid methane heat exchanger and with the second heat exchanger;

a natural gas pipeline in fluid communication with the first heat exchanger; and a liquid air storage vessel in fluid communication with the first heat exchanger, the liquid air expander valve, and the liquid methane heat exchanger; and a liquid air pump in fluid communication with the liquid air storage vessel and the CCNG pipeline;

a CCNG pipeline in fluid communication with the first subsystem;

a second subsystem in fluid communication with the CCNG pipeline; and wherein the CCNG pipeline is configured to deliver liquid air from the first subsystem to the second subsystem, and the CCNG pipeline is further configured to deliver CCNG from the second subsystem to the first subsystem.

7. The system of claim 6, wherein the second subsystem comprises:

a liquid air pump in fluid communication with the CCNG pipeline;

a chilling cycle system in fluid communication with the liquid air pump, a CCNG storage vessel; and a natural gas scrubber; and a natural gas pipeline in fluid communication with the natural gas scrubber.

* * * * *